US006804927B2

(12) United States Patent
Forsyth et al.

(10) Patent No.: US 6,804,927 B2
(45) Date of Patent: Oct. 19, 2004

(54) LATTICE PANEL STRUCTURES

(75) Inventors: Richard Charles Edward Forsyth, Hook (GB); Bevil Guy Mabey, West Wittering (GB); John Meynell Richardson, Monmouth (GB)

(73) Assignee: Mabey & Johnson Limited, Berkshire (GB)

( * ) Notice: Subject to any disclaimer, the term of this patent is extended or adjusted under 35 U.S.C. 154(b) by 0 days.

(21) Appl. No.: 10/257,974

(22) PCT Filed: Apr. 17, 2001

(86) PCT No.: PCT/GB01/01869

§ 371 (c)(1),
(2), (4) Date: Mar. 12, 2003

(87) PCT Pub. No.: WO01/83890

PCT Pub. Date: Nov. 8, 2001

(65) Prior Publication Data

US 2003/0150187 A1 Aug. 14, 2003

(30) Foreign Application Priority Data

Apr. 27, 2000 (GB) ..... 0010308

(51) Int. Cl.[7] ..... E04B 1/18

(52) U.S. Cl. ..... 52/636; 52/652.1; 52/651.1; 52/648.1; 52/645; 14/13; 14/14

(58) Field of Search ..... 52/652.1, 636, 52/638, 645, 650.3, 648.1, 651.1; 14/2, 3, 4, 13, 14

(56) References Cited

U.S. PATENT DOCUMENTS

| | | | | | |
|---|---|---|---|---|---|
| 3,564,803 | A | * | 2/1971 | Breeze et al. | 52/638 |
| 3,835,612 | A | * | 9/1974 | Beziat | 52/638 |
| 4,604,844 | A | * | 8/1986 | Mikulas et al. | 52/632 |
| 4,706,436 | A | * | 11/1987 | Mabey et al. | 52/645 |
| 4,912,795 | A | * | 4/1990 | Johnson | 14/3 |
| 6,161,359 | A | * | 12/2000 | Ono | 52/651.1 |

* cited by examiner

*Primary Examiner*—Carl D. Friedman
*Assistant Examiner*—Jennifer I. Thissell
(74) *Attorney, Agent, or Firm*—Bacon & Thomas, PLLC

(57) ABSTRACT

A modular system for the construction of a lattice panel for a bridge, comprises first and second chord members (20, 28) and a plurality of web members (1). Each web member comprises three legs forming a triangle. One leg (2) extends perpendicularly between the chord members. The second and third legs (3, 4) are joined to each other and to the ends of the first leg. The ends of the first leg (1) are provided with means for connecting the web member to the chords (20, 28). Interlocking means (13, 19) are provided at the joint between the second and third legs, and mid way along the first leg, so that adjacent web members can be connected together.

66 Claims, 10 Drawing Sheets

LATTICE PANEL STRUCTURES

This invention relates to lattice panel structures, such as bridges of the "Bailey" type. The invention is particularly concerned with a modular lattice panel system.

In a typical "Bailey" bridge construction there is provided a main girder at each side of the bridge, transoms extending between the girders and a deck supported on the transoms. The girders are formed from prefabricated lattice panels of steel which are joined together longitudinally. Two or more sets of the lattice panels may be secured together in the vertical direction so as to provide the required depth of girder, and to this end the panels are generally of a rectangular configuration. A common type of lattice panel consists of upper and lower longitudinally extending chords which are joined together by a lattice of web members. These will generally include vertically extending web members and angled web members which may for example extend at an angle of about 45° to the chords. Various panel configurations are disclosed in GB-A-2 251 018, for example.

To join the panels together in end to end relationship to provide the required length of girder, pin and aperture joints are usually employed to ensure speed and simplicity of assembly on site. One end of each chord will be formed with a female portion and one with a male portion. These are mated when the panels are to be joined together and then a transverse pin is inserted through apertures in the portions.

Bridges of the above type are often used as temporary structures, for example to replace bridges destroyed by floods, earthquakes or acts of war. They are supplied as prefabricated components which are assembled on site. In one common method of construction, the bridge girders are assembled on one side of the gap to be bridged, such as a river or ravine, and pushed out and over to the other side.

In a conventional system, the lattice panels are provided as completely prefabricated units with the web members welded to the chords. Typically, a standard length prefabricated panel will be available, and the designer of a bridge will use the appropriate number of these, to be joined end to end, for the bridge.

A significant advantage of using prefabricated panels is that bridges can be constructed quickly with the minimum of on-site fabrication however, there are design constraints due to the limited number of panel configurations available. It is also necessary to restrict the length of the prefabricated panels used as the basic units, so that there is sufficient flexibility to achieve a desired length by joining a number together. however, the joins between adjacent panels can be expensive, particularly if they are of the pin joint variety requiring forgings. The more panel units are required to span a given length, the more joins are required a further problem is that prefabricated panels are bulky to transport.

An object of the present invention is to provide a modular system for constructing lattice panels which provides greater flexibility but which does not increase to an undesirable level the time spent on site to construct a bridge.

Viewed from one aspect the present invention provides a modular system for the construction of a lattice panel for a structure, comprising first and second elongate chord members and a plurality of web members for attachment to the chord members so as to hold them apart transversely, wherein each web member comprises three legs forming a triangle, a first leg being adapted to extend perpendicularly between the chord members, and second and third legs being joined to each other and to adjacent the ends of the first leg, and wherein there are provided the following means for interlocking each web member to the chord members and to like web members:

first interlocking means adjacent one end of the first leg to interlock with corresponding second interlocking means provided at intervals along the first chord member;

third interlocking means adjacent the other-end of the first leg to interlock with corresponding fourth interlocking means provided at intervals along the second chord member;

fifth interlocking means adjacent the join between the second and third legs; and sixth interlocking means intermediate the ends of the first leg;

the arrangement being such that the fifth interlocking means of one web member is adapted to interlock with the sixth interlocking means of an adjacent like web member.

Thus, in use a lattice panel can be constructed with upper and lower chord members and a lattice of web members providing vertical legs extending between and connected to the chord members, and inclined legs which are joined to the vertical legs of adjacent web members. Such an arrangement provides a strong lattice panel.

It is a simple matter to provide lattice panels of desired lengths, by selecting chord members of appropriate lengths and a corresponding number of web members. To cover a certain distance it may be possible to use a single panel constructed from the modular components with long chord members, rather than two or more standard lattice panels joined end to end. From a manufacturing point of view, it is preferable to fabricate and store the modular components capable of forming lattice panels of various lengths, rather than complete lattice panels of various lengths. Furthermore, the conventional joints between lattice panels, typically involving forged components, are expensive. The ability to construct longer panels, simply and from prefabricated components, reduces the total number of panels required for a particular job and thus the number of expensive joints The end user will also have fewer inter-panel joints to assemble if longer panels can be used.

The fabrication of the lattice panels may be carried out at a manufacturing site once an order is received, for shipment to a place of use. Alternatively, the modules may be shipped to the end user for assembly into panels on-site. This may be preferable from a shipping point of view. It may also be possible for the chord members to be manufactured locally if their design is simple enough, this being discussed below, so that only the web members have to be shipped.

It is known for the upper chords of lattice panels to be joined by simple compression joints, for example using abutting flanges and threaded fasteners. These chords can be made on site relatively easily. The lower chord joints are in tension and conventionally they have been in the form of pin joints which provide the required tensile strength whilst being relatively quick and simple to assemble. The pin joints are expensive, forged items, and it is less feasible to manufacture the lower chords on site. In accordance with the present invention, however, it is practical to use longer chords and fewer chord joints. For example, a panel in accordance with the invention may be between three and four times the length of a conventional panel. It is thus feasible to use alternative chord joints for the lower chords, which are cheaper and easier to manufacture even though it may take longer to join two chords. Thus, in one proposed arrangement the lower chord joints are provided by splice plates and several threaded fasteners. An advantage of such a simple joint is that the chords only need to be provided with apertures for the fasteners and it is a more practical proposition for the chords to be made on site.

There may be a number of different chords that can be used For example, a stronger chord could be provided if required. This could be only at suitable positions, such as at the centre of a bridge span. This avoids the need to take a standard lattice panel and add a reinforcing chord to it. It is also possible to introduce camber by using chords of different lengths at the top and bottom of a panel. A longer upper chord will introduce positive camber, resisting the tendency of a bridge to sag in the middle.

The interlocking means should be such that the modules can be assembled in the required orientation and also provide for the transfer of forces. In a preferred embodiment, where two interlocking means interlock, there is provided a male spigot on one member and a matching female recess, for example in the form of an aperture, on the other member. For any interlock there may be one, two, three, four or more such spigots and matching recesses. There may also be fasteners such as threaded bolts secured by nuts to clamp the components together, although the primary purpose of such threaded fasteners will generally not be to transfer forces. In one preferred form, the first and third interlocking means, at opposite ends of the first leg of the web member, comprise spigots. This means that the chords only need to have apertures to constitute the corresponding second and fourth interlocking means. This again helps in simplifying the design of the chords, reducing manufacturing costs and also making it feasible for them to be manufactured on site. However, if desired, reinforcing components could be attached to the chords to receive the spigots.

The fifth and sixth interlocking means, which are provided to join the web members together, preferably also comprise spigots and recesses. For ease of manufacture, at least one of the interlocking means may be provided on a cast member.

In general, the philosophy behind the preferred implementation of the invention is to keep the chords and their joints as simple as possible, and to concentrate the more complex and/or expensive structures on the web members. The design of the modular web member may lend itself to robotic construction, something which has not been considered feasible with the construction of entire lattice panels from individual components.

A web member may be in the form of an isosceles triangle, with the second and third legs of equal length. In such an arrangement, the sixth interlocking means will be arranged on the mid point of the first leg and the fifth interlocking means, where the second and third legs meet, will be aligned with this. In one preferred arrangement, the angle that each of the second and third legs makes with the first legs is about 45°, so that the width of a web member is about one half of its height, i.e the extent of the first leg which extends perpendicularly between the chord members. By using a web member with a longer first leg, it is possible to construct a deeper lattice panel. Preferably, when this is done the angles between the first leg and the second and third legs are preferably reduced to retain the same width for the web member so that it will remain compatible with the same chords, decks and other components used with other web members. In general, the angle between the first leg and the second/third legs is preferably in the range of 35° to 45°. In preferred embodiments, this range can provided panels in the range of about 15 feet (about 4.5 m) to about 23 feet (about 7 m) high Conventional Bailey bridge panels are frequently stacked on each other to increase height, and apart from anything else this doubles the number of chord joints that have to be made.

It will be appreciated that in a practical arrangement the triangle may not be perfect and that the legs might not consist solely of members which meet immediately adjacent their ends, for example. Thus, in one preferred arrangement the second and third legs may be joined together by a junction unit which receives the ends of both legs and is provided with the fifth interlocking means. Similarly, the first leg may comprise a member which is joined at each end to a junction unit. These are respectively attached to the second and third legs, and have the first and third interlocking means for connection to the chord members.

A typical chord member for use in accordance with the present invention be of H section. Such a section will effectively define a pair of channels. One end of a first leg of a web member (in practice, a junction unit) will be received within one channel section of an upper chord, and the other end of the first leg will be received within one channel section of a lower chord.

The web member first legs may each comprise a pair of spaced, parallel elements. These will help to resist outwards deflection of the chords, and in particular the upper chord when a panel is used in a bridge. The spaced elements are preferably tube members, as indeed are the legs of the web members generally. The use of such web members, resistant to deflection, means that there will normally need to be only one line of panels along a side of a bridge, with only a single upper chord and a single lower chord. Frequently in traditional Bailey bridge structures it is necessary to have twin lines of panels. This therefore doubles the number of chord joints and this is another reason why in preferred embodiments of the present invention it is feasible to use chord joints which, individually, take longer to assemble. The preferred web members, being more resistant to deflection, may also make it unnecessary to use additional lateral struts which are frequently used in conventional Bailey bridge structures.

The chord members may be provided with any suitable means for interconnecting them to the chord members of adjacent panels. This include male and female pin joint portions, for receiving either vertical or horizontal pins; apertured plates for receiving bolts or other suitable fasteners as disclosed in GB-A-2 251 018 for example; or any other suitable means. However, as noted earlier, a preferred joint for the upper chords is a compression joint using flanges and fasteners, and a preferred joint for the lower chords is a tension joint using splice plates and fasteners. This also has the advantage that such a joint may more resistant to fatigue, as it does not require the use of welding to attach forged pin joint components to the chords.

When a lattice panel is constructed using the chord members and web members as described above, at one end there may be the second and third legs of a web member projecting beyond the ends of the chords; and at the other end there will then be a first leg of another web member positioned inwardly of the ends of the chords. Joining two lattice panels together will involve joining the upper and lower chords together, and also joining the projecting web member to the web member of the adjacent panel.

For use in a bridge or similar structure, preferably the first leg of a web member is provided with means for attachment to a transom which will support a deck. The connection between the leg and the transom may be by means of a spigot and recess, for example a trapezoidal cross section recess on the first leg and a matching spigot on the transom. In practice, it may only be necessary to attach a transom to alternate web members. The web members which are not to be attached to transoms may not be provided with the necessary attachment means, and they may even have lighter first legs as they will be required to withstand less stress than the first legs of the other web members. Where s transom is attached, the upright first legs form the uprights of a stress transmitting "U". At the ends of a structure, there could be stronger web members with sturdier upright legs and if desired also sturdier diagonal legs, to account for increased shear forces. These end web members could be provided with means for attachment to transoms. Other web members could be provided for various purposes as required. For example, a special web member adapter could be provided so that a bridge can be launched using a conventional launcher nose used with current Bailey type bridges.

The invention may be viewed from various different aspects, dealing with the system in broad terms, a web member for use in the system, novel lattice panels constructed using the system, a bridge or other lattice panel structure such as a tower constructed using the system, a method of constructing such a structure, and so forth.

For example, viewed from one aspect the present invention provides a prefabricated web member for use in a system as described above, comprising three legs forming a triangle, wherein:

a first leg comprises an elongate member having at each end respective first and second mounting plates perpendicular to the axis of the first leg, each mounting plate being provided with first interlocking means for connection to a chord member and with at least one aperture to receive a fastener to secure the mounting plate to the chord member;

the second and third legs extend at an acute angle from adjacent the ends of the first leg to a junction where there is provided a third mounting plate whose plane is parallel to the longitudinal direction of the first leg, the third mounting plate being provided with second interlocking means for connection to another web member and with at least one aperture to receive a fastener to secure the mounting plate to the other member; and the first member is provided with a fourth mounting plate intermediate its ends whose plane is parallel to the longitudinal direction of the first leg, the plate being provided with third interlocking means for connection to the second interlocking means of another web member, and also being provided with at least one aperture to receive a fastener to secure the plate to the other web member.

Some embodiments of the invention will now be described by way of example and with reference to the accompanying drawings in which.

Figure 1:
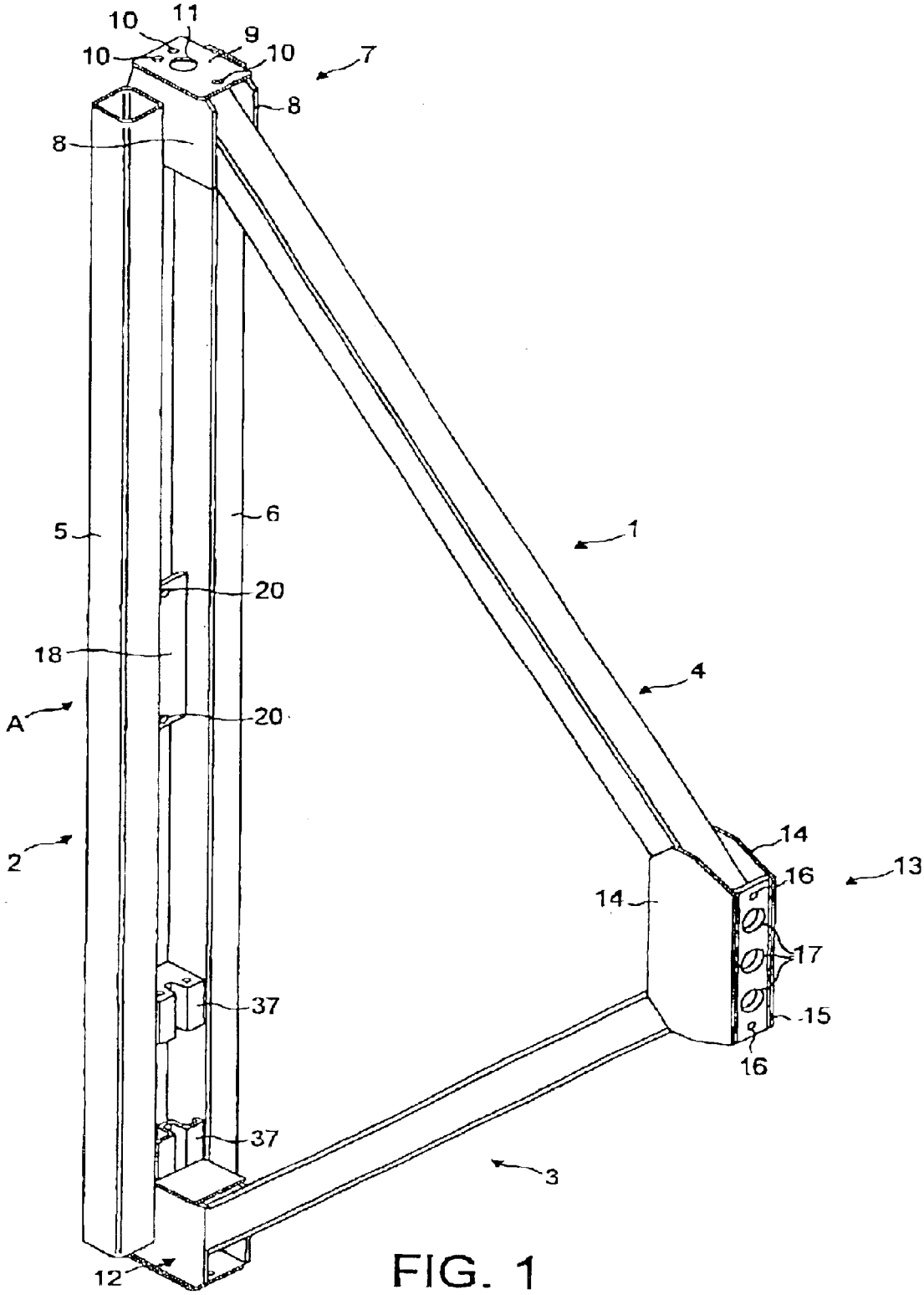
FIG. 1 is a perspective view of a web member for use in a system in accordance with the invention.

In FIG. 1 a steel web member 1 is of generally triangular shape, having an elongate upright leg 2 and two legs 3 and 4 of equal length, inclined at about 45° to the upright leg. The upright leg 2 comprises a pair of spaced, parallel, square section tubes 5 and 6 At the upper end of the leg 2 is a junction unit 7 which is welded between the tubes 5 and 6. This includes a pair of spaced vertical plates 8 between which is welded the end of leg 4, and a horizontal plate 9. The plane of horizontal plate 9 is therefore perpendicular to the elongate axis of upright leg 2. The plate 9 has three apertures 10 for receiving fasteners, and a large central aperture 11 for receiving a locating lug to interlock the web member to an upper chord. At the lower end of the upright leg 2 is a corresponding junction unit 12, which receives the end of leg 3 and is adapted to be connected to a lower chord. This has a plate and apertures corresponding to those in the upper unit 7.

The other ends of legs 3 and 4 are received by a third junction unit 13 this comprises a pair of spaced vertical plates 14, between which the ends of the legs are welded, and a vertical plate 15. The vertical plate 15 comprises a pair of apertures 16 for receiving fasteners, and three large, vertically spaced apertures 17 for receiving locating lugs on a like web member. The junction unit 13 is positioned vertically mid way relative to the upright leg 2.

Figure 2:
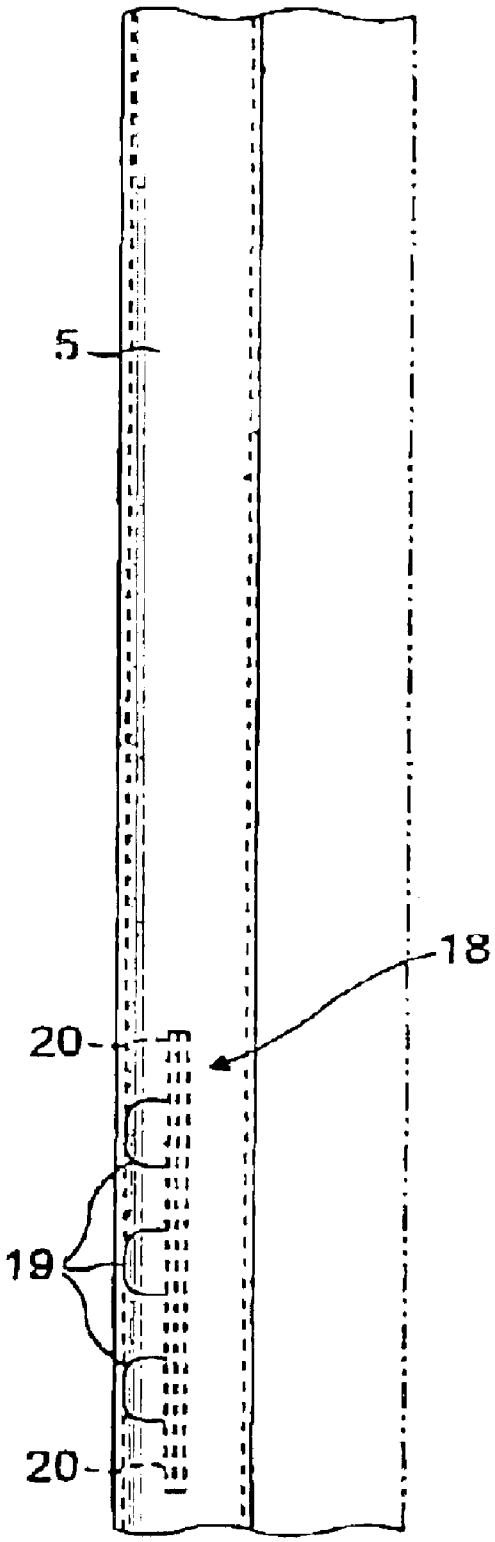
FIG. 2 is a side view of part of the web member in the region A marked on FIG. 1.

Mid way up the upright leg 2 is provided a mounting plate 18, welded to the tubes 5 and 6. With reference to FIG. 2, this is provided with three vertically spaced lugs 19 which are adapted to mate with the apertures 17 on a plate 15 of a like member. Apertures 20 are provided, to be aligned with apertures 16 on the plate 15 of a like member, so that the two plates 18 and 15 can be secured together, e.g. by means of threaded fasteners and nuts, and thus two web members joined together.

Figure 3:
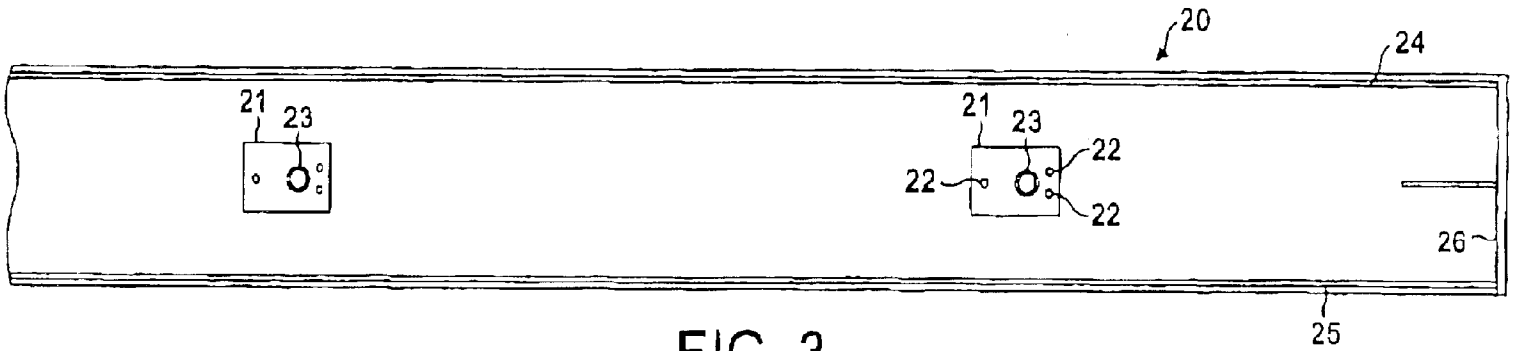
FIG. 3 is an underneath plan view of part of an upper chord used in the system.
Figure 4:
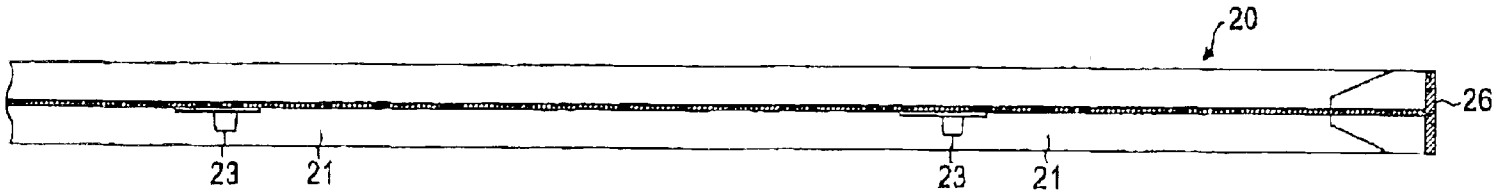
FIG. 4 is a section through the part of the upper chord.

FIG. 3 is an underneath view of part of a steel upper chord 20 of H section, and FIG. 4 is a section through part of the chord. Spaced along the upper chord 20 at equal intervals are location means in the form of plates 21. Each plate 21 has three apertures 22 for receiving threaded fasteners, and a downwardly projecting lug 23. The lug 23 is configured to locate inside the aperture 11 in plate 9, on the end of leg 2 of a web member. The apertures 22 will then be aligned with the apertures 10 in the plate so that the web member can be attached to the upper chord by means of nuts and bolts. The junction unit 7 on the web member fits in the space between the flanges 24 and 25 of the lower part of the "H" section of the upper chord 20. At each end of the upper chord there is provided a transverse plate 26 which is apertured at 27 (FIG. 7) so that two chords of adjacent panels can be joined together by abutting the plates 26 and securing them by means of bolts passing through the apertures.

Figure 5:
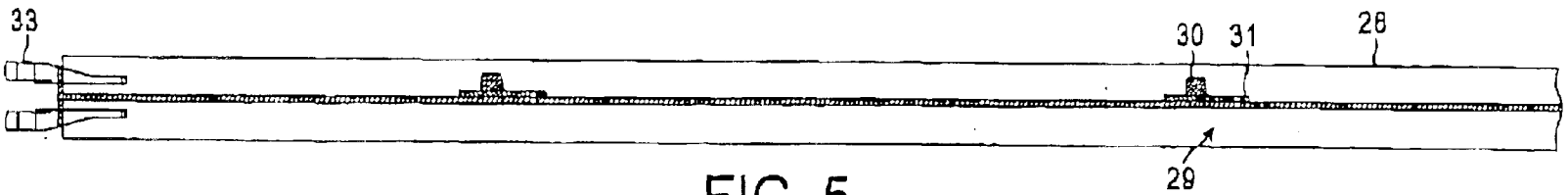
FIG. 5 is a section through part of a lower chord.

FIG. 5 shows a lower chord 28 in section, this also being a steel H section member. This has plates 29 spaced at equal intervals along its length, defining lugs 30 and apertures 31. These are adapted to cooperate with corresponding apertures in the lower junction unit 12 of the leg 2 of a web member, in the same way that the upper unit 7 is secured to the upper chord 20. In this manner a web member 1 can be secured between the upper and lower chords, with the upright leg 2 extending perpendicularly between them.

It will be appreciated that in the above arrangement, the web members are secured to the transverse portions of the "H" section upper and lower chords. This means that the width of the chords can be varied, for example so as to increase or decrease their strength, without affecting the connections with the web members. With a conventional structure, the web forming members are frequently connected to the vertical flanges forming the legs of the H section chords. Thus, in such conventional arrangements, varying the widths of the chords would vary the spacing between the flanges to which the web forming members need to be attached. It will also be appreciated that with the new arrangement described above, it is possible to use a single chord with web members of different widths, provided they fit in the space between the vertical flanges.

It is possible to mix the widths of the chords used in a particular bridge, for example to increase strength where there is high loading. It should be noted that the compression type of joint used on the upper chords facilitates this. Apertures can be aligned in the transverse end plates 26 of the upper chords, even if the overall widths are different.

The lower chord has pin joint portions at its end for joining to adjacent lower chords, in this arrangement comprising a pair of male portions 32 at one end (FIGS. 6 and 7) and a pair of female portions 33 at the other end. The portions can be joined together by vertical pins 34 (FIG. 7).

Figure 6:
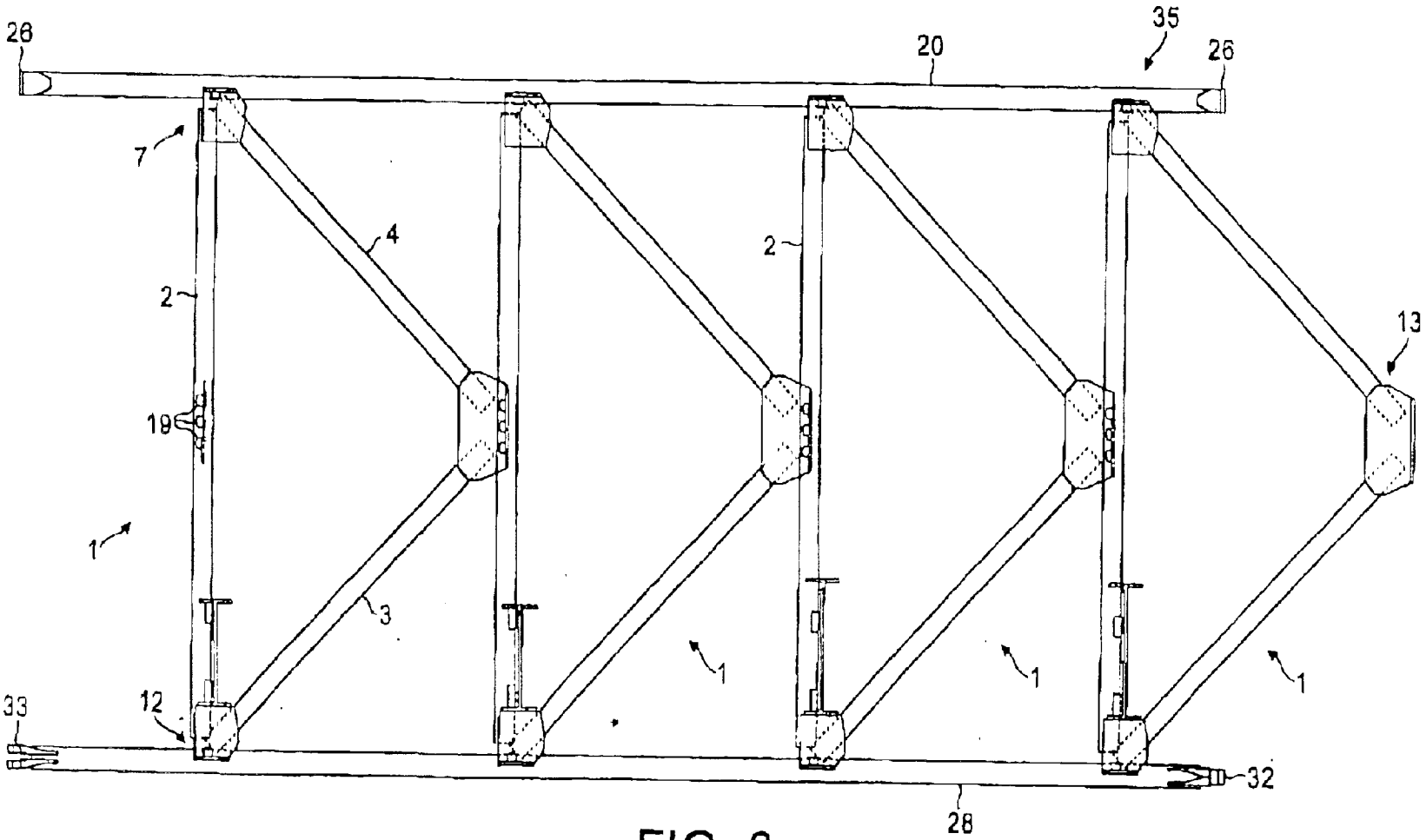
FIG. 6 is a side view of a lattice panel using the web members and chords.

FIG. 6 is a side view of a lattice panel 35 comprising upper chord 20, lower chord 28 and four web members 1. Each of these is joined to the chords as described above, so that the upright legs 2 extend substantially perpendicularly between the chords. The web members 1 are also joined to each other. The lugs 19 on the upright leg 2 of one web member are engaged in the apertures 17 of the junction unit 13 of an adjacent panel, and the web members are joined together by nuts and bolts through the mating apertures 16 and 20.

To construct a bridge member, a number of panels 35 are joined end to end. The plates 26 of adjacent upper chords, and the pint joint portions 32 and 33 of adjacent lower chords are joined as described above. In addition, the junction unit 13 of the protruding web member of one panel mates with the lugs 19 of the adjacent panel, and the two web members are joined together as described above.

Figure 7:
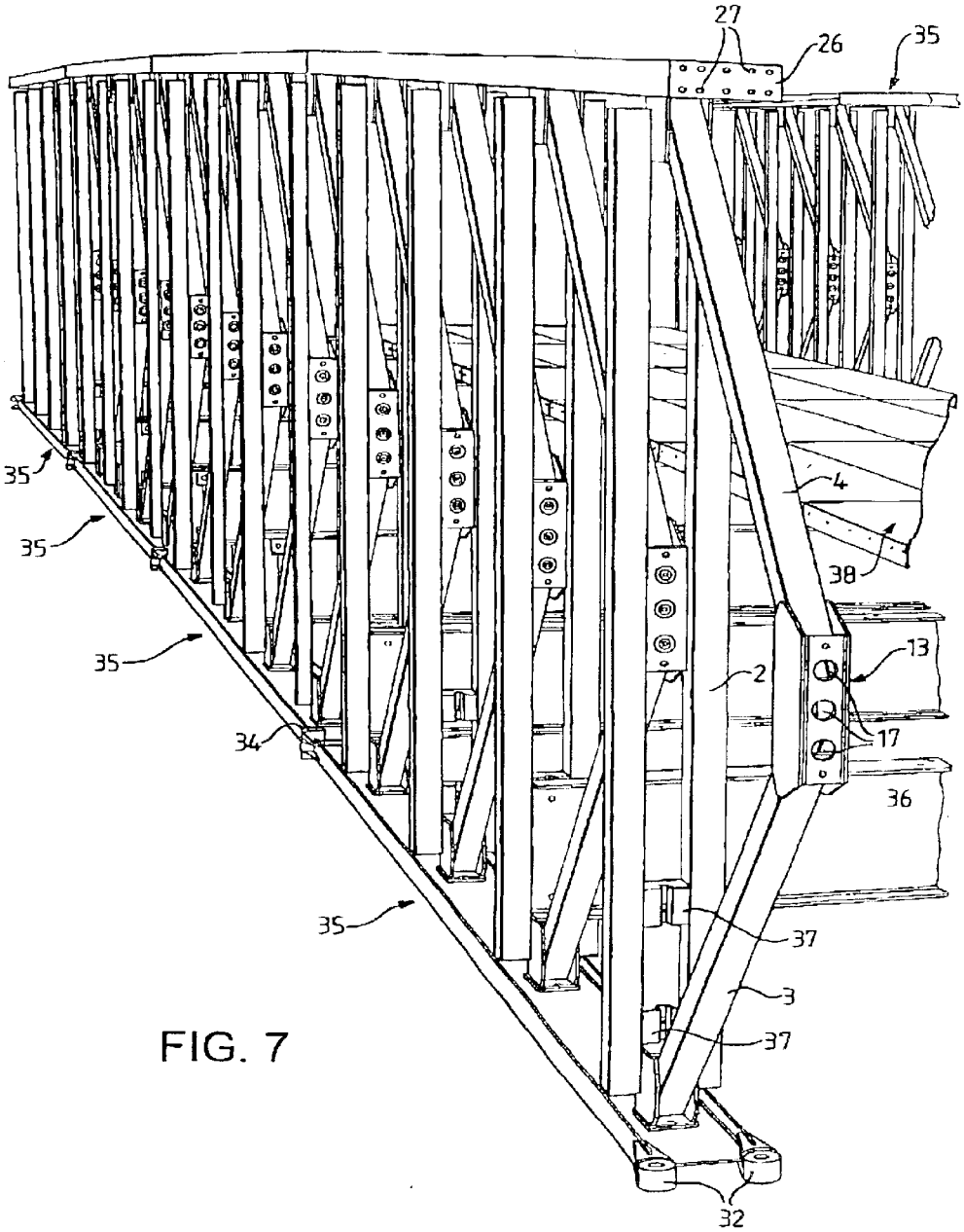
FIG. 7 is a perspective view of part of a bridge constructed using a number of the lattice panels.

As shown in FIG. 7, a number of panels 35 are joined together end to end to form a left hand side member of a bridge, and a number are also joined together end to end to form a right hand side member. Transverse supports 36 are attached to the panels, by means of junction blocks 37 which are provided on each upright web member leg 2, welded between the tubes 5 and 6. The transverse supports are secured by threaded fasteners. Decking 38 is laid over the transverse supports 36. The junction blocks 37 have trapezoidal recesses which receive spigots on the transverse supports. As a threaded fastener is tightened, it urges a spigot into the tapered trapezidal recess thus tightening the engagement between the spigot and recess. This reduces play in the connection between the trabnsverse suppports 36 and the web members and reduces misalignment. Misalignment can reduce the stability of the upper chord in particular.

As described above, four web members 1 are used for each panel 35, However, longer or shorter chords can be used, and more or fewer web members, so as to produce panels of different lengths.

Figure 8:
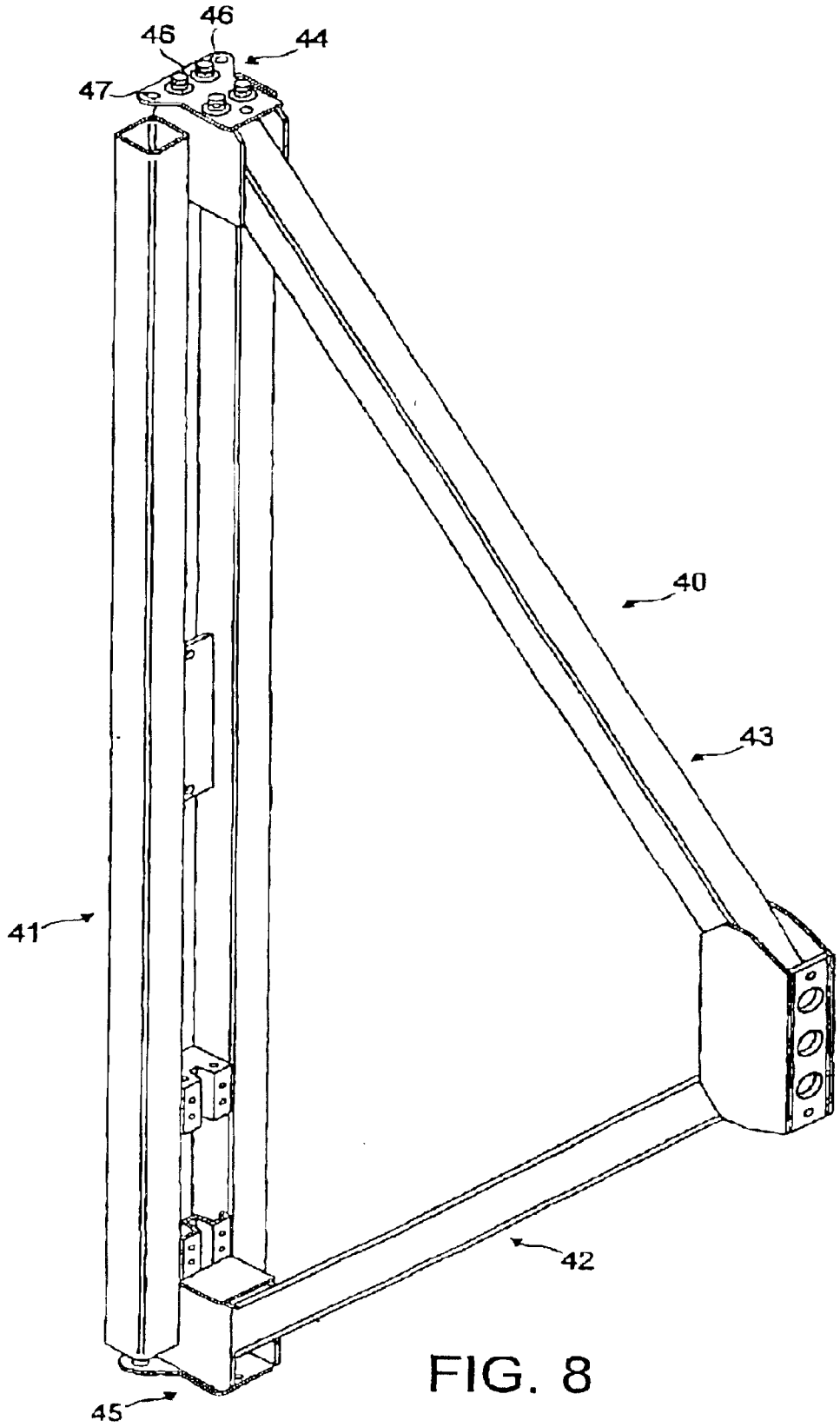
FIG. 8 is a perspective view of a modified web member.
Figure 9:
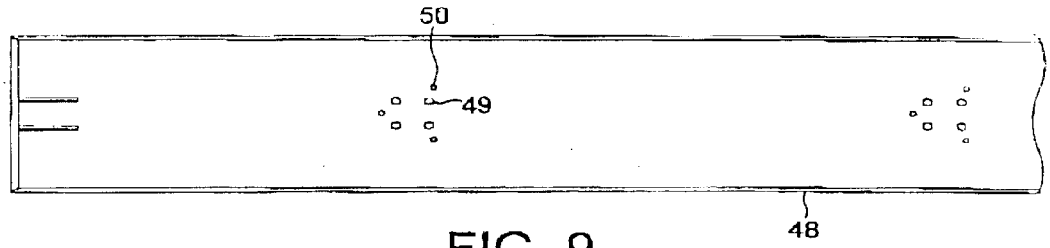
FIG. 9 is a plan view of an upper chord for use with the web member of FIG. 8.
Figure 10:
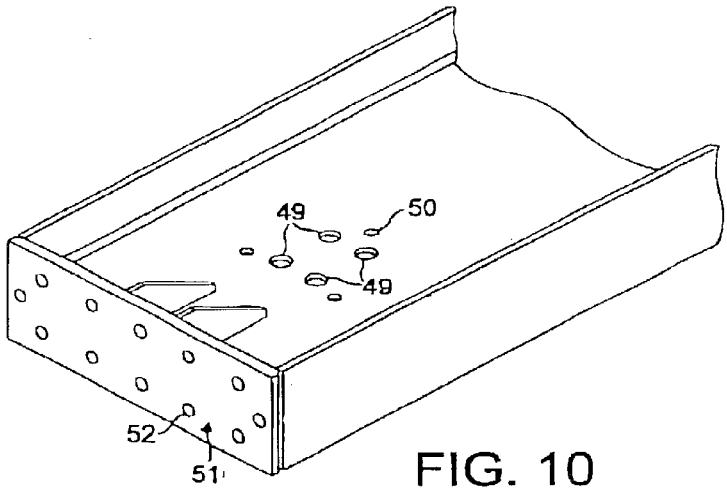
FIG. 10 is an end view of the chord of FIG. 9.

FIGS. 8 to 14 illustrate a modified system. Many components are the same and their description is not repeated. FIG. 8 shows a modified web member 40 with legs 41, 42 and 43. At either end of leg 41 are interlocking means 44 and 45 for use with upper and lower chords respectively. Each interlocking means is provided with four spigots 46 and three apertures 47 for receiving fasteners. FIG. 9 shows an upper chord 48 for use with the modified web member 40. Along its length are interlocking means each comprising four apertures to receive spigots 46 and three apertures to match apertures 47 and receive threaded fasteners. As shown in FIG. 10, the end of the chord member is provided with a plate 51 having apertures 52, so that it can be attached to a like chord to form a compression joint.

Figure 11:
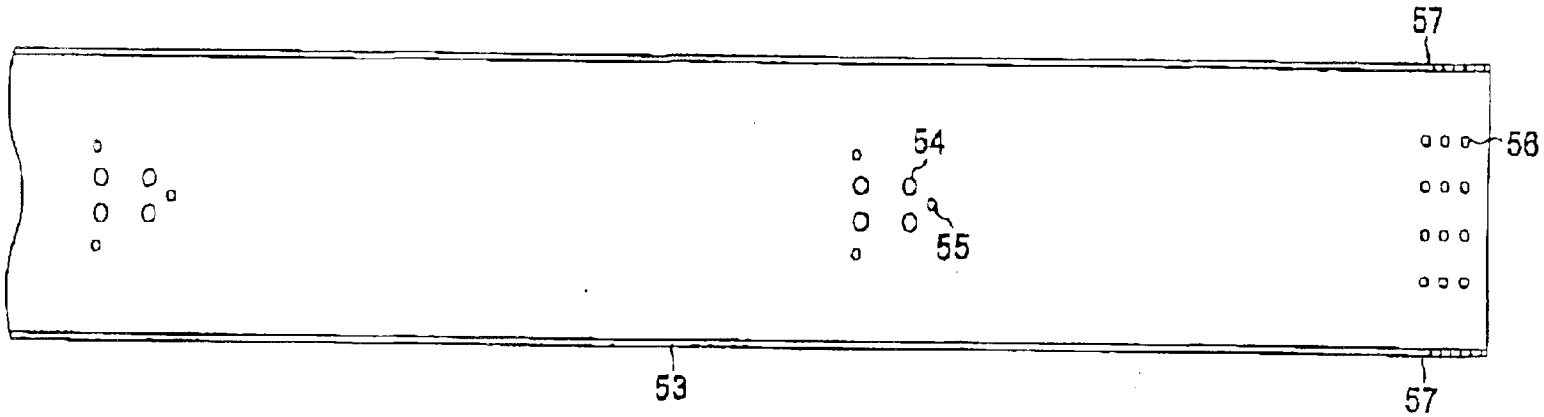
FIG. 11 is a plan view of a lower chord for use with the web member of FIG. 8.
Figure 12:
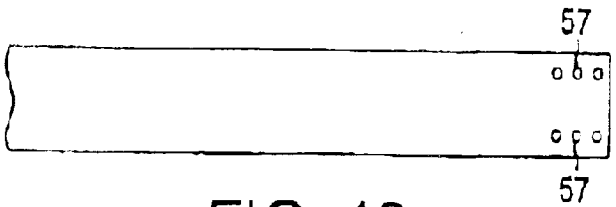
FIG. 12 is an side view of the chord of FIG. 11.

FIG. 11 shows a bottom chord 53 which like chord 48 has interlocking means along its length comprising apertures 54 to receive spigots of interlocking means 45 of the web member 40 and apertures 55 to receive threaded fasteners. At its end it is provided with twelve apertures 56 and twelve side apertures 57 (FIG. 12) so that it can be attached to a like chord by a splice plate and fasteners passing through the apertures.

Figure 13:
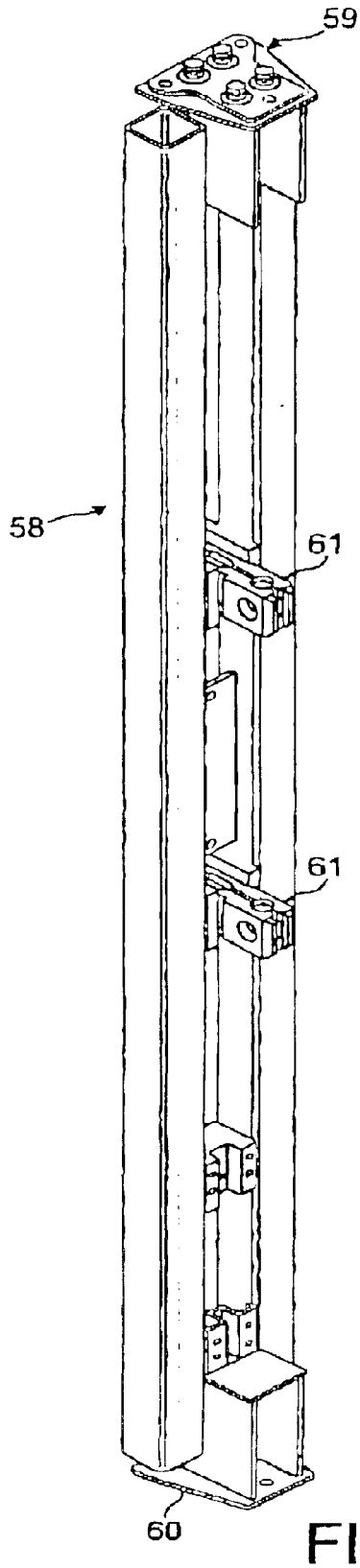
FIG. 13 is perspective view of an end post for use in a system with the components of FIGS. 8 to 12.

FIG. 13 shows an end post 58 for use in a system with web member 40 and chords 48 and 53. It has the same interlocking means 59, 60 at its ends. It also has additional connectors 61 which can be used to attach a launch "nose" of a conventional type for when a bridge is being pushed out over a river or the like.

Figure 14:
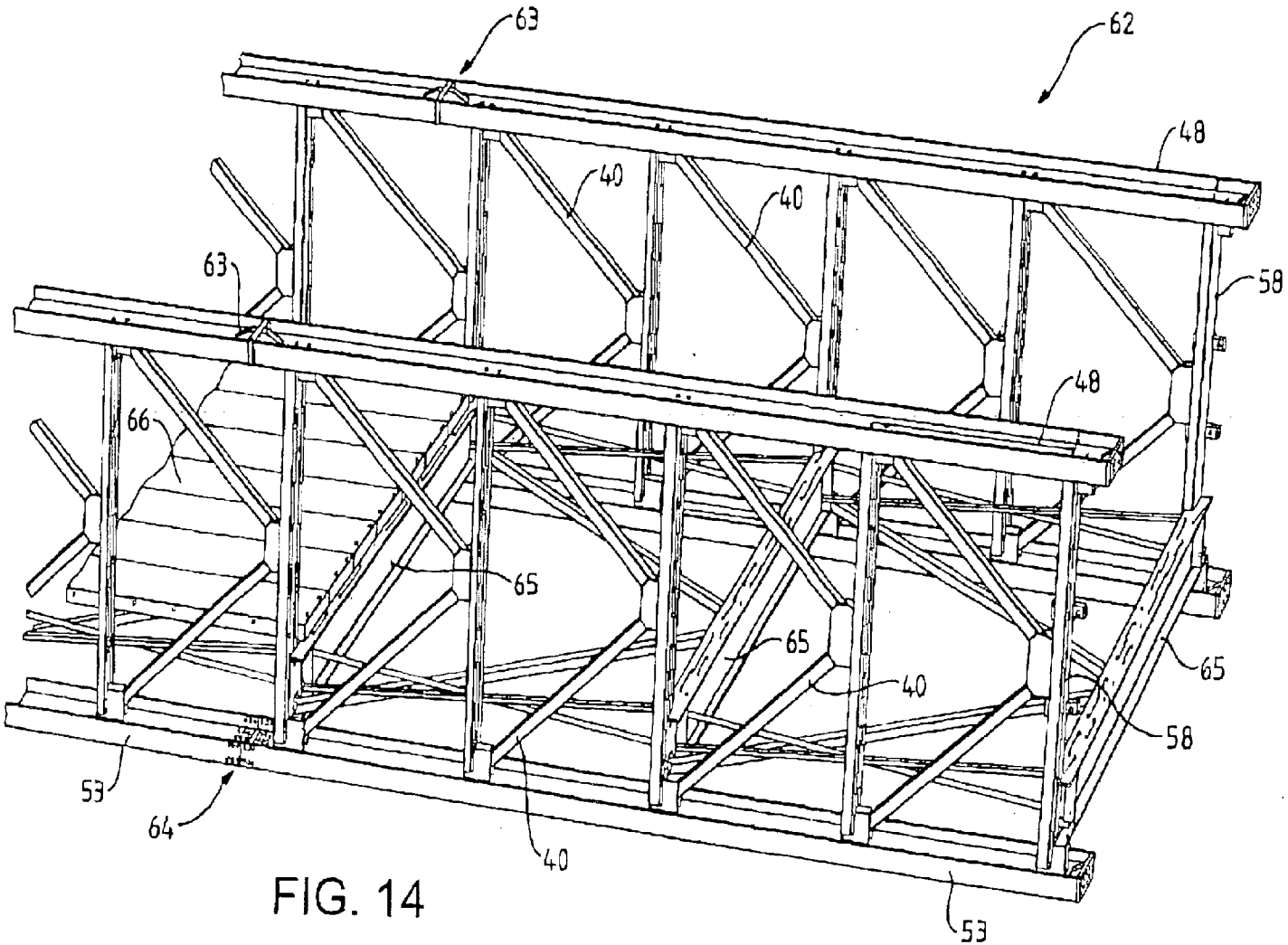
FIG. 14 is a perspective view of part of a bridge using the components of FIGS. 8 to 13.

FIG. 14 shows part of a bridge 62 using the components of FIGS. 8 to 13. It shows web members 40, upper chords 48 joined at 63, lower chords 53 joined at 64, end posts 58, transoms 65 extending between the web members and between the end posts, and part of a deck 66 laid on the transoms.

What is claimed is:

1. A modular system for the construction of a lattice panel for a structure, comprising first and second elongate chord members and a plurality of web members for attachment to the chord members so as to hold them apart transversely, wherein each web member comprises three legs forming a triangle, a first leg being adapted to extend perpendicularly between the chord members, and second and third legs being joined to each other and to adjacent the ends of the first leg, and wherein there are provided the following means for interlocking each web member to the chord members and to like web members:

first interlocking means adjacent one end of the first leg to interlock with corresponding second interlocking means provided at intervals along the first chord member;

third interlocking means adjacent the other end of the first leg to interlock with corresponding fourth interlocking means provided at intervals along the second chord member;

fifth interlocking means adjacent the join between the second and third legs; and sixth interlocking means intermediate the ends of the first leg;

the arrangement being such that the fifth interlocking means of one web member is adapted to interlock with the sixth interlocking means of an adjacent like web member;

wherein the first leg is provided at each end with a junction unit, one being attached to the second leg and having the first interlocking means for connection to a chord member, and one being attached to the third leg and having the third interlocking means for connection to a chord member.

2. A system as claimed in claim 1, wherein the web member is in the form of an isosceles triangle, with the second and third legs oaf equal length.

3. A system as claimed in claim 2, wherein each of the second and third legs is inclined to the first leg at an angle of between about 35° to 45°.

4. A system as claimed in claim 1, wherein the second and third legs are joined together by a junction unit which receives the ends of both legs and is provided with the fifth interlocking means.

5. A system as claimed in claim 1, wherein one of the first and second interlocking means comprises a spigot and the other comprises a recess adapted to receive the spigot.

6. A system as claimed in claim 5, wherein said one of the first and second interlocking means comprises a plurality of spigots.

7. A system as claimed in claim 5, wherein the said one of the first and second interlocking means is the first interlocking means.

8. A system as claimed in claim 5, wherein the first and second interlocking means further comprise aligned apertures for receiving fasteners to secure the web member to the chord member.

9. A system as claimed in claim 1, wherein one of the third and fourth interlocking means comprises a spigot and the other comprises a recess adapted to receive the spigot.

10. A system as claimed in claim 9, wherein said one of the third and fourth interlocking means comprises a plurality of spigots.

11. A system as claimed in claim 9, wherein the said one of the third and fourth interlocking means is the third interlocking means.

12. A system as claimed in claim 9, wherein the third and fourth interlocking means further comprise aligned apertures for receiving fasteners to secure the web member to the chord member.

13. A system as claimed in claim 1, wherein one of the fifth and sixth interlocking means comprises a spigot and the other comprises a recess adapted to receive the spigot.

14. A system as claimed in claim 13, wherein the fifth and sixth interlocking means further comprise aligned apertures for receiving fasteners to secure one web member to an adjacent web member.

15. A system as claimed in claim 13, wherein one of the fifth and sixth interlocking means comprises a plurality of vertically spaced spigots and the other comprises a corresponding plurality of apertures adapted to receive the spigots.

16. A system as claimed in claim 1, wherein the first leg comprises a pair of parallel, spaced elements.

17. A system as claimed in claim 1, wherein the first leg of at least some of the web members comprises means for attachment to a transom.

18. A system as claimed in claim 1, wherein one of the chord members is provided with apertured flanges at its ends and is configured to form compression joints with chord members of like panels with fasteners passing through the apertures.

19. A system as claimed in claim 1, wherein one of the chord members is provided with apertures at its ends and is configured to form tension joints with chord members of like panels with splice plates and fasteners passing through the splice plates and the apertures.

20. A system as claimed in claim 16 wherein the parallel, spaced elements are tubular.

21. A system as claimed in claim 1, wherein the first leg of the web member comprises an elongate member having at each end respective first and second mounting plates perpendicular to the axis of the first leg, one mounting plate being provided with the first interlocking means for connection to a chord member and with at least one aperture to receive a fastener to secure the mounting plate to the chord member, and the other mounting plate being provided with the third interlocking means for connection to a chord member and with at least one aperture to receive a fastener to secure the mounting plate to the chord member;

the second and third legs of the web member extend at an acute angle from adjacent the ends of the first leg to a junction where there is provided a third mounting plate whose plane is parallel to the longitudinal direction of the first leg, the third mounting plate being provided with the fifth interlocking means for connection to another web member and with at least one aperture to receive a fastener to secure the mounting plate to the other member; and the first leg of the web member is provided with a fourth mounting plate intermediate its ends whose plane is parallel to the longitudinal direction of the first leg, the plate being provided with the sixth interlocking means for connection to the second interlocking means of another web member, and also being provided with at least one aperture to receive a fastener to secure the plate to the other web member.

22. A lattice panel constructed from a system as claimed in claim 1, comprising the upper and lower chord members and a plurality of the web members connected to the chord members and to each other.

23. A structural member comprising a plurality of panels as claimed in claim 22 joined end to end, with the upper chords of adjacent panels connected together, the lower chords of adjacent panels connected together, and a web member of one panel being connected to a web member of an adjacent panel by means of the fifth interlocking means of the web member of one panel being interlocked with the sixth interlocking means of the web member of the other panel.

24. A structure comprising a structural member as claimed in claim 23.

25. A structure as claimed in claim 24, in the form of a bridge.

26. A prefabricated web member for use as the web member in a system as claimed in any of claims 1, comprising three legs forming a triangle, wherein:

a first leg comprises an elongate member having at each end respective first and second mounting plates perpendicular to the axis of the first leg, one mounting plate being provided with the first interlocking means for connection to a chord member and with at least one aperture to receive a fastener to secure the mounting plate to the chord member, and the other mounting plate being provided with the third interlocking means for connection to a chord member and with at least one aperture to receive a fastener to secure the mounting plate to the chord member;

the second and third legs extend at an acute angle from adjacent the ends of the first leg to a junction where there is provided a third mounting plate whose plane is parallel to the longitudinal direction of the first leg, the third mounting plate being provided with the fifth interlocking means for connection to another web member and with at least one aperture to receive a fastener to secure the mounting plate to the other member; and the first leg is provided with a fourth mounting plate intermediate its ends whose plane is parallel to the longitudinal direction of the first leg, the plate being provided with the sixth interlocking means for connection to the second interlocking means of another web member, and also being provided with at least one aperture to receive a fastener to secure the plate to the other web member.

27. A web member as claimed in claim 26, wherein the second and third legs are of substantially equal lengths.

28. A web member as claimed in claim 27, wherein each of the second and third legs extends at from about 35° to 45° to the first leg.

29. A web member as claimed in claim 26, wherein one of the fifth and sixth interlocking means comprises a spigot and the other comprises a recess adapted to receive the spigot.

30. A web member as claimed in claim 29, wherein one of the fifth and sixth interlocking means comprises a plurality of vertically spaced spigots and the other comprises a corresponding plurality of apertures adapted to receive the spigot.

31. A web member as claimed in any of claims 26, wherein each of the first and third interlocking means comprises a spigot.

32. A web member as claimed in any of claims 26, wherein the first leg comprises a pair of parallel, spaced elements.

33. A web member as claimed in claim 32 wherein the parallel, spaced elements are tubular.

34. A modular system for the construction of a lattice panel for a structure, comprising first and second elongate chord members and a plurality of web members for attachment to the chord members so as to hold them apart transversely, wherein each web member comprises three legs forming a triangle, a first leg being adapted to extend perpendicularly between the chord members, and second and third legs being joined to each other and to adjacent the ends of the first leg, and wherein there are provided the following means for interlocking each web member to the chord members and to like web members:

first interlocking means adjacent one end of the first leg to interlock with corresponding second interlocking means provided at intervals along the first chord member;

third interlocking means adjacent the other end of the first leg to interlock with corresponding fourth interlocking means provided at intervals along the second chord member;

fifth interlocking means adjacent the join between the second and third legs; and sixth interlocking means intermediate the ends of the first leg;

the arrangement being such that the fifth interlocking means of one web member is adapted to interlock with the sixth interlocking means of an adjacent like web member;

wherein the first leg comprises a pair of parallel, spaced elements.

35. A modular system for the construction of a lattice panel for a structure, comprising first and second elongate chord members and a plurality of web members for attachment to the chord members so as to hold them apart transversely, wherein each web member comprises three legs forming a triangle, a first leg being adapted to extend perpendicularly between the chord members, and second and third legs being joined to each other and to adjacent the ends of the first leg, and wherein there are provided the following means for interlocking each web member to the chord members and to like web members:

first interlocking means adjacent one end of the first leg to interlock with corresponding second interlocking means provided at intervals along the first chord member;

third interlocking means adjacent the other end of the first leg to interlock with corresponding fourth interlocking means provided at intervals along the second chord member;

fifth interlocking means adjacent the join between the second and third legs; and sixth interlocking means intermediate the ends of the first leg;

the arrangement being such that the fifth interlocking means of one web member is adapted to interlock with the sixth interlocking means of an adjacent like web member;

wherein the first leg of at least some of the web members comprises means for attachment to a transom.

36. A modular system for the construction of a lattice panel for a structure, comprising first and second elongate chord members and a plurality of web members for attachment to the chord members so as to hold them apart transversely, wherein each web member comprises three legs forming a triangle, a first leg being adapted to extend perpendicularly between the chord members, and second and third legs being joined to each other and to adjacent the ends of the first leg, and wherein there are provided the following means for interlocking each web member to the chord members and to like web members:

first interlocking means adjacent one end of the first leg to interlock with corresponding second interlocking means provided at intervals along the first chord member;

third interlocking means adjacent the other end of the first leg to interlock with corresponding fourth interlocking means provided at intervals along the second chord member;

fifth interlocking means adjacent the join between the second and third legs; and sixth interlocking means intermediate the ends of the first leg;

the arrangement being such that the fifth interlocking means of one web member is adapted to interlock with the sixth interlocking means of an adjacent like web member;

wherein the first leg comprises a pair of parallel, spaced tubular elements.

37. A modular system for the construction of a lattice panel for a structure, comprising first and second elongate chord members and a plurality of web members for attachment to the chord members so as to hold them apart transversely, wherein each web member comprises three legs forming a triangle, a first leg being adapted to extend perpendicularly between the chord members, and second and third legs being joined to each other and to adjacent the ends of the first leg, and wherein there are provided the following means for interlocking each web member to the chord members and to like web members:

first interlocking means adjacent one end of the first leg to interlock with corresponding second interlocking means provided at intervals along the first chord member;

third interlocking means adjacent the other end of the first leg to interlock with corresponding fourth interlocking means provided at intervals along the second chord member;

fifth interlocking means adjacent the join between the second and third legs; and sixth interlocking means intermediate the ends of the first leg;

the arrangement being such that the fifth interlocking means of one web member is adapted to interlock with the sixth interlocking means of an adjacent like web member;

wherein the first leg of the web member comprises an elongate member having at each end respective first and second mounting plates perpendicular to the axis of the first leg, one mounting plate being provided with the first interlocking means for connection to a chord member and with at least one aperture to receive a fastener to secure the mounting plate to the chord member, and the other mounting plate being provided with the third interlocking means for connection to a chord member and with at least one aperture to receive a fastener to secure the mounting plate to the chord member;

wherein the second and third legs of the web member extend at an acute angle from adjacent the ends of the first leg to a junction where there is provided a third mounting plate whose plane is parallel to the longitudinal direction of the first leg, the third mounting plate being provided with the fifth interlocking means for connection to another web member and with at least one aperture to receive a fastener to secure the mounting plate to the other member; and wherein the first leg of the web member is provided with a fourth mounting plate intermediate its ends whose plane is parallel to the longitudinal direction of the first leg, the plate being provided with the sixth interlocking means for connection to the second interlocking means of another web member, and also being provided with at least one aperture to receive a fastener to secure the plate to the other web member.

38. A bridge comprising a structural member formed from a plurality of lattice panels joined end to end, each lattice panel being of modular construction and having:

an upper elongate chord member;

a lower elongate chord member; and a plurality of web members which are connected to the chord members to hold them apart vertically and which are also connected to each other; wherein:

the upper chords of adjacent panels are connected together, the lower chords of adjacent panels are connected together, and a web member of one panel is connected to a web member of an adjacent panel; and wherein:

each web member comprises three legs forming a triangle, a first leg being adapted to extend perpendicularly between the chord members, and second and third legs being joined to each other and to adjacent the ends of the first leg, and wherein there are provided the following means for interlocking each web member to the chord members and to like web members:

first interlocking means adjacent one end of the first leg to interlock with corresponding second interlocking means provided at intervals along the upper chord member;

third interlocking means adjacent the other end of the first leg to interlock with corresponding fourth interlocking means provided at intervals along the lower chord member;

fifth interlocking means adjacent the join between the second and third legs; and sixth interlocking means intermediate the ends of the first leg;

the arrangement being such that the fifth interlocking means of one web member in one lattice panel is interlocked with the sixth interlocking means of an adjacent like web member in the said one lattice panel, and the fifth interlocking means of another web member in said one panel is interlocked with the sixth interlocking means of a web member in an adjacent lattice panel.

39. A bridge as claimed in claim 38, wherein the web member is in the form of an isosceles triangle, with the second and third legs of equal length.

40. A bridge as claimed in claim 39, wherein each of the second and third legs is inclined to the first leg at an angle of between about 35° to 45°.

41. A bridge as claimed in claim 38, wherein the second and third legs are joined together by a junction unit which receives the ends of both legs and is provided with the fifth interlocking means.

42. A bridge as claimed in claim 38, wherein the first leg is provided at each end with a junction unit, one being attached to the second leg and having the first interlocking means for connection to a chord member, and one being attached to the third leg and having the third interlocking means for connection to a chord member.

43. A bridge as claimed in claim 38, wherein one of the first and second interlocking means comprises a spigot and the other comprises a recess adapted to receive the spigot.

44. A bridge as claimed in claim 43, wherein said one of the first and second interlocking means comprises a plurality of spigots.

45. A bridge as claimed in claim 43, wherein the said one of the first and second interlocking means is the first interlocking means.

46. A bridge as claimed in claim 43, the first and second interlocking means further comprise aligned apertures for receiving fasteners to secure the web member to the chord member.

47. A bridge as claimed in claim 38, wherein one of the third and fourth interlocking means comprises a spigot and other comprises a recess adapted to receive the spigot.

48. A bridge as claimed in claim 47, wherein said one of the third and fourth interlocking means comprises a plurality of spigots.

49. A bridge as claimed in claim 47, wherein the said one of the third and fourth interlocking means is the third interlocking means.

50. A bridge as claimed in claim 47, wherein the third and fourth interlocking means further comprise aligned apertures for receiving fasteners to secure the web member to the chord member.

51. A bridge as claimed in claim 38, one of the fifth and sixth interlocking means comprises a spigot and the other comprises a recess adapted to receive the spigot.

52. A bridge as claimed in claim 51, wherein the fifth and sixth interlocking means further comprise aligned apertures for receiving fasteners to secure one web member to an adjacent web member.

53. A bridge as claimed in claim 51, wherein one of the fifth and sixth interlocking means comprises a plurality of vertically spaced spigots and the other comprises a corresponding plurality of apertures adapted to receive the spigots.

54. A bridge as claimed in claim 38, wherein the first leg comprises a pair of parallel, spaced elements.

55. A bridge as claimed in claim 38, wherein the first leg of at least some of the web members comprises means for attachment to a transom.

56. A bridge as claimed in claim 38, wherein one of the chord members is provided with apertured flanges at its ends to form compression joints with chord members of like panels by the use of fasteners passing through the apertures.

57. A bridge as claimed in 38, wherein one of the chord members is provided with apertures at its ends to form tension joints with chord members of like panels by the use of splice plates and fasteners passing through the splice plates and the apertures.

58. A bridge as claimed in claim 54 wherein the parallel, spaced elements are tubular.

59. A prefabricated web member for use in a modular system for the construction of a lattice panel for a structure, the modular system comprising first and second elongate chord members and a plurality of said web members for attachment to the chord members so as to hold them apart transversely, wherein the web member comprises three legs forming a triangle, a first leg being adapted to extend perpendicularly between the chord members, and second and third legs being joined to each other and to adjacent the ends of the first leg, and wherein there are provided the following means for interlocking the web member to the chord members and to like web members:

first interlocking means adjacent one end of the first leg to interlock with corresponding second interlocking means provided at intervals along the first chord member;

third interlocking means adjacent the other end of the first leg to interlock with corresponding fourth interlocking means provided at intervals along the second chord member;

fifth interlocking means adjacent the join between the second and third legs; and sixth interlocking means intermediate the ends of the first leg;

the arrangement being such that the fifth interlocking means of the web member is adapted to interlock with the sixth interlocking means of an adjacent like web member; and wherein said first leg comprises an elongate member having at each end respective first and second mounting plates perpendicular to the axis of the first leg, one mounting plate being provided with the first interlocking means for connection to a chord member and with at least one aperture to receive a fastener to secure the mounting plate to the chord member, and the other mounting plate being provided with the third interlocking means for connection to a chord member and with at least one aperture to receive a fastener to secure the mounting plate to the chord member;

said second and third legs extend at an acute angle from adjacent the ends of the first leg to a junction where there is provided a third mounting plate whose plane is parallel to the longitudinal direction of the first leg, the third mounting plate being provided with the fifth interlocking means for connection to another web member and with at least one aperture to receive a fastener to secure the mounting plate to the other member; and said first leg is provided with a fourth mounting plate intermediate its ends whose plane is parallel to the longitudinal direction of the first leg, the plate being provided with the sixth interlocking means for connection to the second interlocking means of another web member, and also being provided with at least one aperture to receive a fastener to secure the plate to the other web member.

60. A web member as claimed in claim 59, wherein the second and third legs are of substantially equal lengths.

61. A web member as claimed in claim 60, wherein each of the second and third legs extends at from about 35° to 45° to the first leg.

62. A web member as claimed in claim 59, wherein one of the fifth and sixth interlocking means comprises a spigot and the other comprises a recess adapted to receive the spigot.

63. A web member as claimed in claim 62, wherein one of the fifth and sixth interlocking means comprises a plurality of vertically spaced spigots and the other comprises a corresponding plurality of apertures adapted to receive the spigot.

64. A web member as claimed in claim 59, wherein each of the first and third interlocking means comprises a spigot.

65. A web member as claimed in claim 59, wherein the first leg comprises a pair of parallel, spaced elements.

66. A web member as claimed in claim 65 wherein the parallel, spaced elements are tubular.

* * * * *

UNITED STATES PATENT AND TRADEMARK OFFICE

CERTIFICATE OF CORRECTION

PATENT NO. : 6,804,927 B2
DATED : October 19, 2004
INVENTOR(S) : Richard Charles Edward Forsyth It is certified that error appears in the above-identified patent and that said Letters Patent is hereby corrected as shown below:

Title page,
Item [22], PCT Filed, should be -- Apr. 27, 2001 --

Signed and Sealed this

Twenty-second Day of February, 2005

JON W. DUDAS
*Director of the United States Patent and Trademark Office*